US007543603B2

(12) United States Patent
Wang et al.

(10) Patent No.: US 7,543,603 B2
(45) Date of Patent: Jun. 9, 2009

(54) THREE-WAY, TWO-POSITION IN-TUBE SOLENOID GAS VALVE ASSEMBLY

(76) Inventors: Wei-Ching Wang, 1791 Branchwood Park, Mississauga, Ontario (CA) L4W 2E5; Chia-ping Wang, 1791 Branchwood Park, Mississauga, Ontario (CA) L4W 2E5; Yu-ching Wang, 1791 Branchwood Park, Mississauga, Ontario (CA) L4W 2E5

( * ) Notice: Subject to any disclaimer, the term of this patent is extended or adjusted under 35 U.S.C. 154(b) by 345 days.

(21) Appl. No.: 11/344,488

(22) Filed: Feb. 1, 2006

(65) Prior Publication Data

US 2007/0175529 A1 Aug. 2, 2007

(51) Int. Cl.
*F15B 13/04* (2006.01)

(52) U.S. Cl. ..... 137/596.2; 137/625.49; 137/625.5; 137/596.16; 91/420

(58) Field of Classification Search ..... 137/625.25, 137/625.27, 625.65, 625.67, 625.68, 596.1, 137/596.17, 596.2, 625.48, 625.49, 625.5, 137/106, 596.16; 91/420
See application file for complete search history.

(56) References Cited

U.S. PATENT DOCUMENTS 2,832,200 A * 4/1958 Grout et al. ..... 91/183
3,270,626 A * 9/1966 Bradbury ..... 92/113
3,273,468 A * 9/1966 Allen ..... 91/420
4,197,785 A * 4/1980 Weber ..... 91/468

* cited by examiner

*Primary Examiner*—Stephen M Hepperle
*Assistant Examiner*—Craig M Schneider
(74) *Attorney, Agent, or Firm*—Steven H. Leach; Ridout & Maybee LLP

(57) ABSTRACT

A tube defines a cavity. Normally-open fitting (2) and normally-closed fitting (3) are respectively fitted into the tube to form ports (34),(35) having seats (40),(13). A body secured to fitting (3) defines a chamber (26) to which port (35) leads. Body (4) defines holes (27),(30) leading into chamber (26). A solenoid assembly (6) is slidable within chamber (26), includes a coil, segregates chamber (26) to chambers (7),(29) which communicate respectively with holes (27),(30) and defines a chamber (16), a seat (18), a seal (14) and an orifice (33) leading between seat (18) and seat (13). A rod-piston assembly includes a rod (37) attached to: assembly (6), sealably passing through body (4) into cavity and preventing gas communication between cavity and chamber (7); and a piston with a seal (39). A magnetic rod (15) slides within chamber (16). Spring (17) urges rod (15) towards seat (18) to seal orifice (33). Spring (12) urges assembly (6) towards seat (13) to seal port (35). The coil moves rod (15) and assembly (6). Assembly (6) and the rod-piston assembly are movable between positions wherein: the piston seals against seat (40); and wherein seal (14) seals against seat (13).

3 Claims, 7 Drawing Sheets

THREE-WAY, TWO-POSITION IN-TUBE SOLENOID GAS VALVE ASSEMBLY

FIELD OF THE INVENTION

The primary application field of the invention relates to a solenoid valve and more particularly, to a three-way, two-position in-tube solenoid gas valve assembly to switch the gas passage in high pressure pneumatic system.

BACKGROUND OF THE INVENTION

Compared to hydraulic systems, pneumatic systems often have many disadvantages in different fields of applications in the present market. For example, the typical pressure range of hydraulic system is from 500 to 5,000 psig while a typical pneumatic system, the common pressure range from 0 to 80 psig, sometimes up to 1,000 psig for some special applications. However, there are reasons people would prefer a pneumatic system to a hydraulic one because of the simplicity of a pneumatic system which provides a low cost. In addition, a pneumatic system can be easily adapted to current applications and can be less sensitive to environmental factors. Since the hydraulic power system requires more complex conversion equipment which is not suitable for the portable or movable applications; hence, the demand of high pressure gas in pneumatic system is increasing. High pressure pneumatics can reach a higher stiffness than that of less pressure so that it provides a much stronger support than the low pressure system. The three-way solenoid valve of prior arts, U.S. Pat. No. 5,135,027 and 5,618,087, has been disclosed. In those inventions, the piston or ball is directly driven by a solenoid device that is actuated by an electrical signal to enable the system. However, those solenoid valves are not applicable in high pressure pneumatic system. There are also many poppet and spool type solenoid valves in the market. For example, in the prior art, U.S. Pat. No. 5,996,629, it has a movable spool (a valve body) which is driven by solenoid devices in a cylindrical chamber (a valve hole), communicating with several intersect channels, to switch the route of fluid passage. The gap distance between the spool and the chamber is very crucial. Normally, the surface of the spool has to be very smooth so that the gap distance can be controlled. The chamber and channels in a manifold are made by milling and subsequent finishing procedures. However, burrs are generated during machining procedure; hence, to clean all foreign material as well as burrs before assembling the valve is mandatory. Due to the inefficiency of the manual operation processes of cleaning and de-burring, the quality control of production of valve is dismal. In this invention, an innovative design, described hereafter, based on the prior art, U.S. patent application Ser. No. 10/924,789, in-tube solenoid gas valve, is a three-way, two-position solenoid valve assembly. This assembly consists of a modified in-tube solenoid gas valve and two additional gas release valves to reach a fast and reliable operation. In this design, a solenoid gas valve is used to control the direction of the flow while the movement of the pneumatic system is controlled by the pressure difference exerted by the high pressure gas.

SUMMARY OF THE INVENTION

Accordingly, it is an object of the present invention to provide a three-way, two-position in-tube solenoid gas valve assembly of the above mentioned general type which avoids the disadvantages of the prior arts.

It is also an object of the present invention to provide a three-way, two-position in-tube solenoid gas valve assembly that can be used for high pressure pneumatic system.

It is also an object of the present invention to provide a three-way, two-position in-tube solenoid gas valve assembly that will virtually act instantaneously.

It is also an object of the present invention to provide a three-way, two-position in-tube solenoid gas valve assembly that will save the manufacturing costs.

A three-way, two-position in-tube solenoid gas valve assembly according to the invention has an inlet in the valve tube located in the radial direction of a modified in-tube solenoid gas valve and two outlets at each end of the modified in-tube solenoid gas valve. An extend piston molded with plastic insert is connected to a solenoid assembly with a rod. The gas flow through one of the outlet to one side of a pneumatic system when the solenoid is not energized. When solenoid is energized, the solenoid assembly is moved by gas pressure differential force, to let gas flow to the other side of the pneumatic system at the meantime, the extend piston, pushed by the solenoid assembly, closes one of the outlet. There are two gas release valves that are used for releasing gas in the pneumatic system. When the supply gas flows to the acting side of the pneumatic system, the gas in the other side of the pneumatic system is pushed out by the piston and is released by one of the gas release valves.

The modified in-tube solenoid gas valve, as described in the prior art, U.S. patent application Ser. No. 10/924,789, having the characteristic function that open and close valve instantaneously, acts as the main component of this three-way, two-position in-tube solenoid gas valve assembly. The modified in-tube solenoid gas valve controls the flow direction of the gas into the pneumatic system.

A gas release valve comprises of a body piston and a cap piston, which are actuated by gas pressure from the outlets of the modified in-tube solenoid gas valve. The gas release valve helps the residue gas in the pneumatic system to escape.

The novel features which are considered as characteristics for the present invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENT

Figure 1:
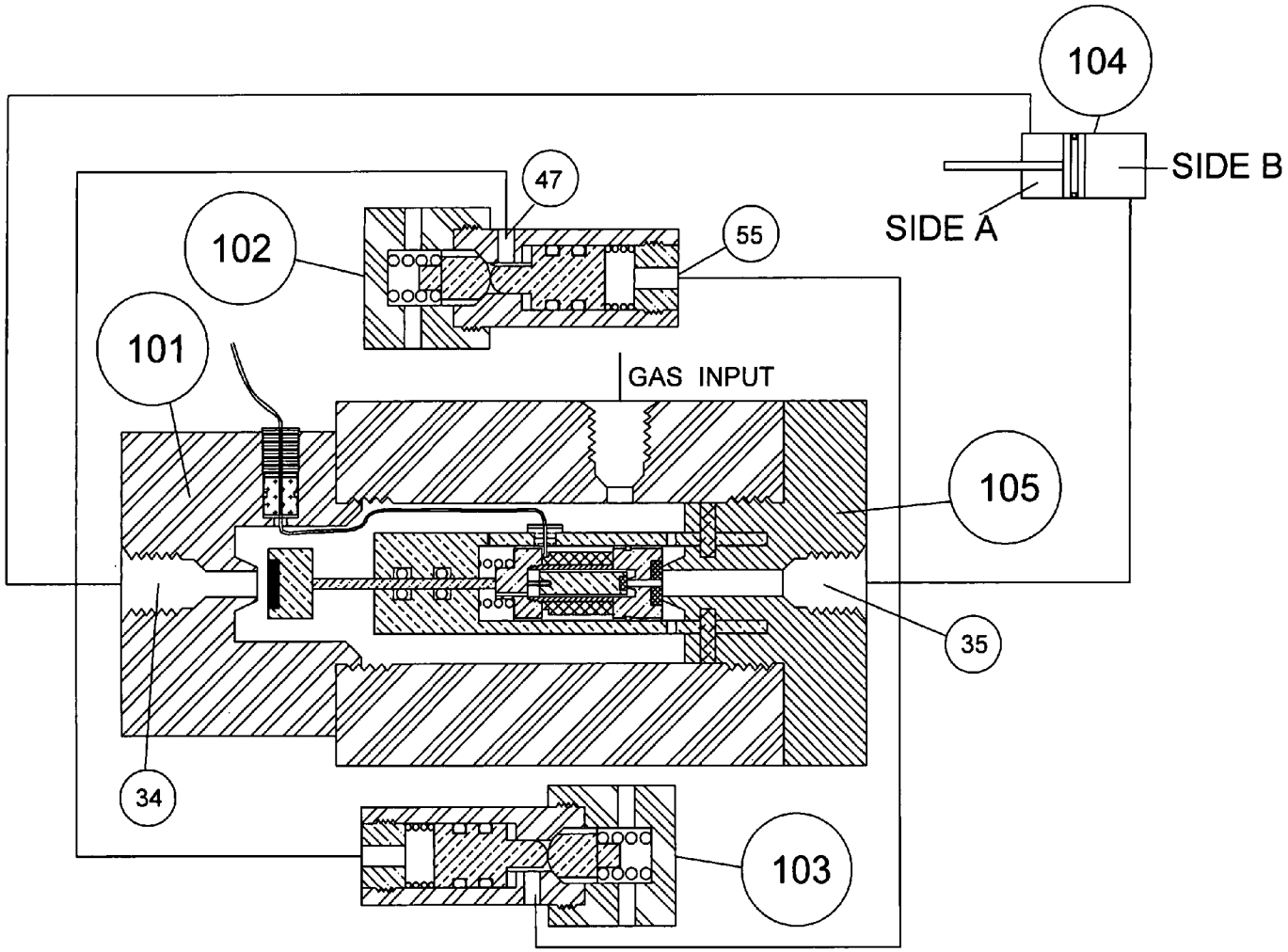
FIG. 1 is a schematic diagram of a pneumatic system with a three-way, two-position in-tube solenoid gas valve assembly.

Attention is first directed to FIG. 1, which shows a schematic diagram of a pneumatic system cylinder 104 having sides A and B is attached to a three-way, two-position, in-tube solenoid valve assembly, which consists of a modified in-tube solenoid gas valve 101 and two identical gas release valves 102 and 103. Side A of cylinder 104 is connected to exiting port 34 of the modified in-tube solenoid gas valve 101, port 47 of gas release valve 102 and port 55 of gas release valve 103. Side B of cylinder 104 is connected to the existing port 35 of the modified in-tube solenoid gas valve 101, port 55 of gas release valve 102 and port 47 of gas release valve 103.

Figure 2:
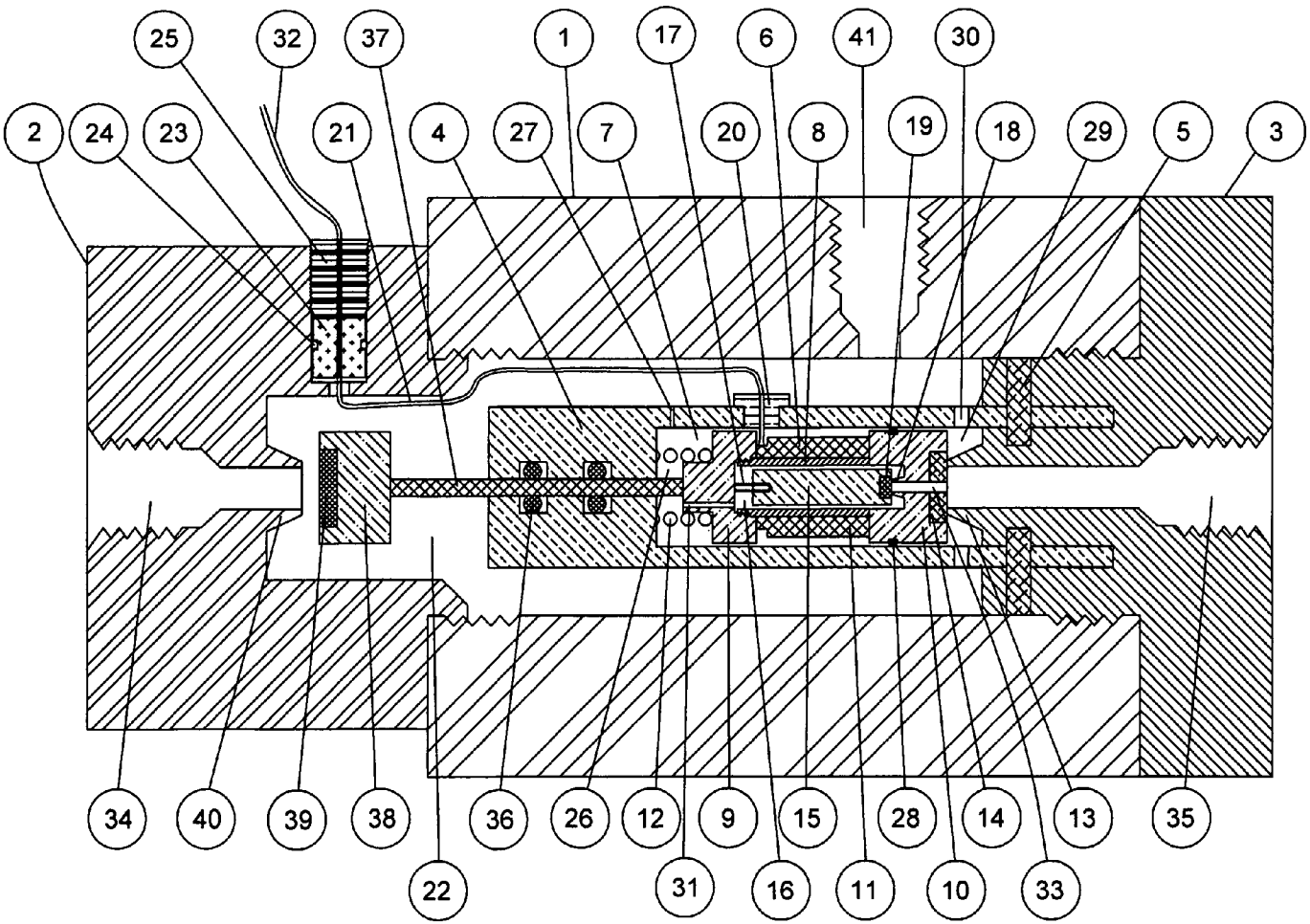
FIG. 2 is a cross-sectional view of a modified in-tube solenoid gas valve.

FIG. 2 shows a section view of a modified in-tube solenoid gas valve 101. The valve tube 1 has a hollow hole with internal thread at both ends to accept both outlet fittings 2 and 3. Both fittings have an exiting port 34 and 35 respectively with internal threads for connecting adaptive fittings of piping system. A gas input port 41 is located at a side of the valve tube 1 of the modified in-tube solenoid gas valve 101. Cavity 22 is formed by the valve body 1, the two outlet fittings 2 and 3.

A support cylindrical body 4 having only one chamber 26 provides a space for the movement of a solenoid assembly 6 that comprises a hollow sleeve 8, a stop 9, flange 10 and an electrical coil 11. The opening end of the cylindrical body 4 is connected to the outlet fitting 3 with pins 5. An o-ring 28 on the outside of flange 10 divides chamber 26 into a front side chamber 7 and back side chamber 29. A rod 37 with extended piston 38 connects the movable solenoid assembly 6, and is supported by the cylindrical body 4. A pair of o-ring 36 blocks the gas communication between chamber 26 and cavity 22. A plastic insert 39 which is molded on extended piston 38 presses on a seal seat 40 of outlet fitting 2 to provide a seal.

A compression spring 12 pushes the solenoid assembly 6 to a seal seat 13 of the outlet fitting 3 at the initial state. A plastic insert 14 is molded onto the flange 10 to provide seal. A magnetic rod 15 moveable axially in hollow chamber 16 of hollow sleeve 8, while a compression spring 17 pushes magnetic rod 15 against a interior orifice seal seat 18 of the flange 10 at the initial state. A rubber insert 19 is molded onto magnetic rod 15 to provide seal.

An internal pass-through plug 20, inserting into support cylindrical body 4, provides the strain relief of lead wires of coil 21 which extends from electrical coil 11, through the support cylindrical body 4, to the cavity 22 of the valve tube 1. The lead wires of coil 21 are soldered onto the terminals of an external pass-through connector 23 at the bottom of connector 23. The external pass-through connector 23 is placed in the outlet fitting 2 with an o-ring 24 that seals high pressure gas. Because of the high pressure in the valve tube 1, a metal plug 25 with a centre hole is threaded into the outlet fitting to hold the external pass-through connector 23. Lead wire 32 connects to lead wire of coil 21 and connects to a external power supply.

Figure 3:
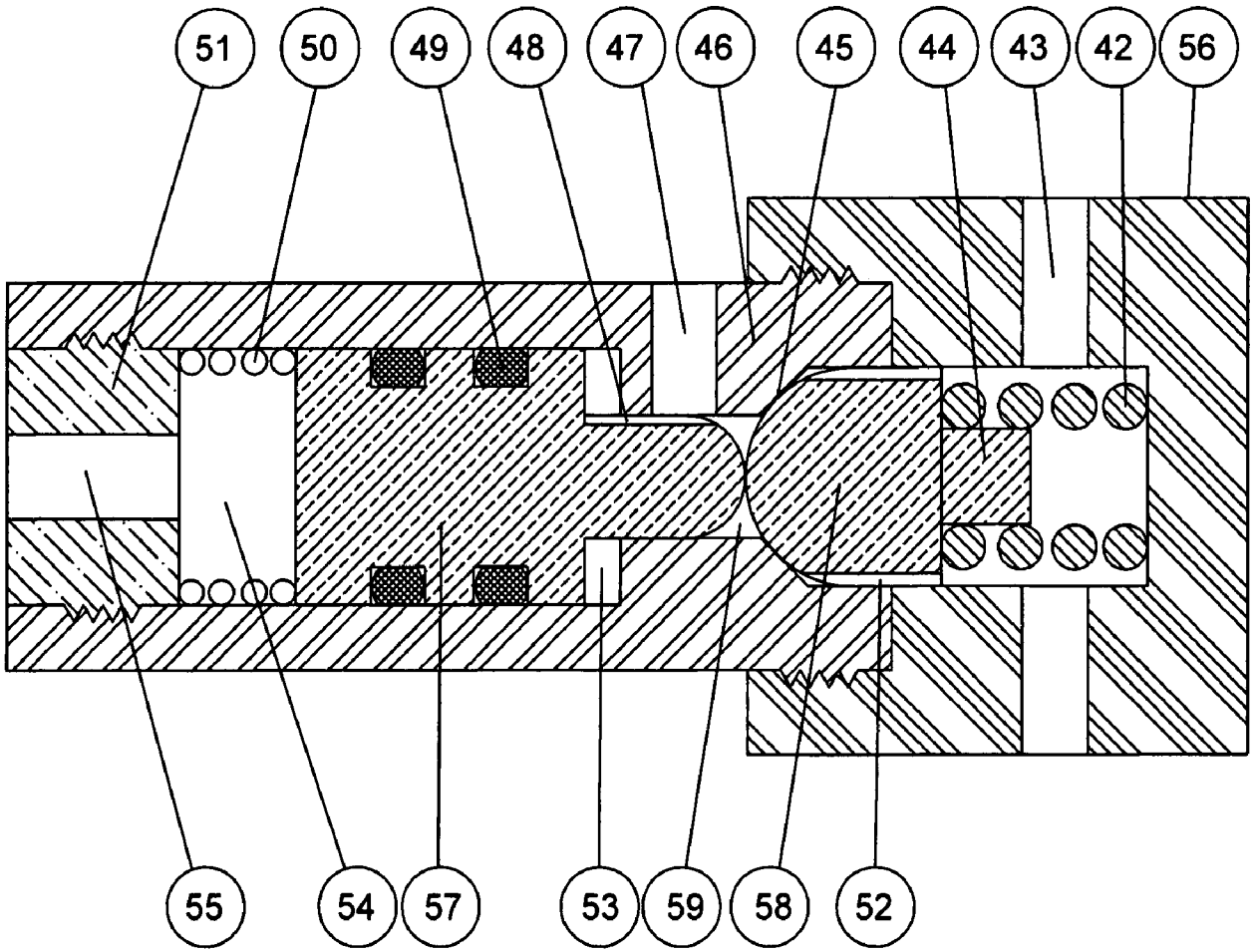
FIG. 3 is a cross-sectional view of a gas release valve.

FIG. 3 displays a section view of a gas release valve which consists of a cap 56 with a body 46 threaded into the cap 56. Cap 56 consists of a compression spring 42 and a cap piston 58 which movable within chamber 52 of the cap 56. Cap 56 has through ports 43 to provide a gas outlet to the atmosphere. Body 46 consists of a body piston 57, a compression spring 50 and an inlet fitting 51. A contact surface between cap piston 58 and the threaded side of body 46 defines a sealing seat (45). Body piston 57 is moveable within chamber 54. A pair of o-ring 49 prevents the communication of gas between chambers 53 and 54. A port 47 is located at the side of the body 46 to provide a gas inlet. The inlet fitting 51 having a port 55 to provide gas inlet is threaded into body 46. A gas communication groove 48 is for the connecting the port 47 and front body piston chamber.

Figure 4:
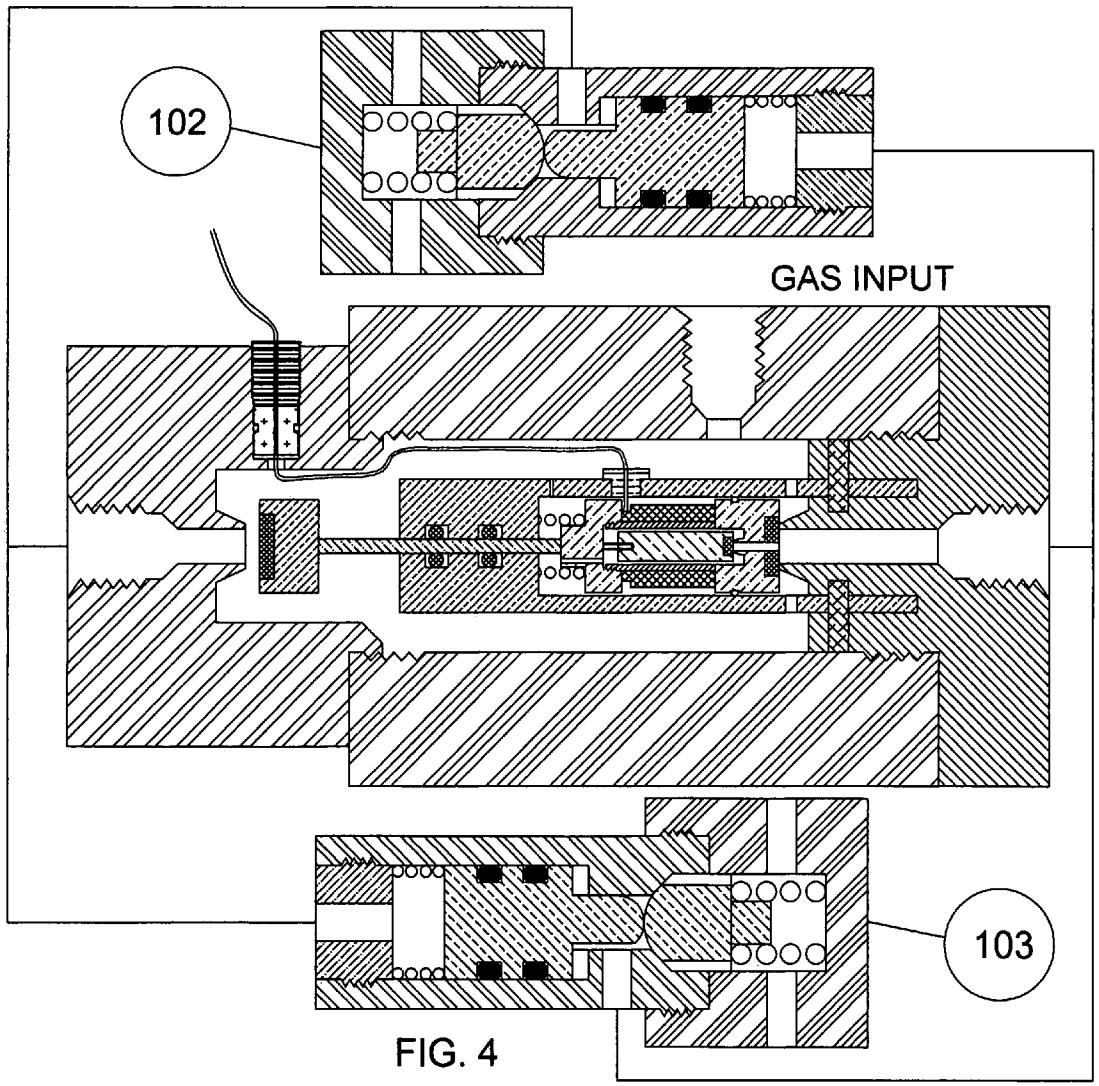
FIG. 4 is a connection diagram of modified in-tube solenoid gas valve and two gas release valves in the state of no gas is in valves.

FIG. 4 displays the entire assembly configuration that the pneumatic system is not being used. It also shows the initial state of the assembly. Initially, the solenoid is inactive and there is no gas flow into the modified solenoid gas valve 101; outlet fitting 2 is normally open; and outlet fitting 3 is normally closed.

Figure 5:
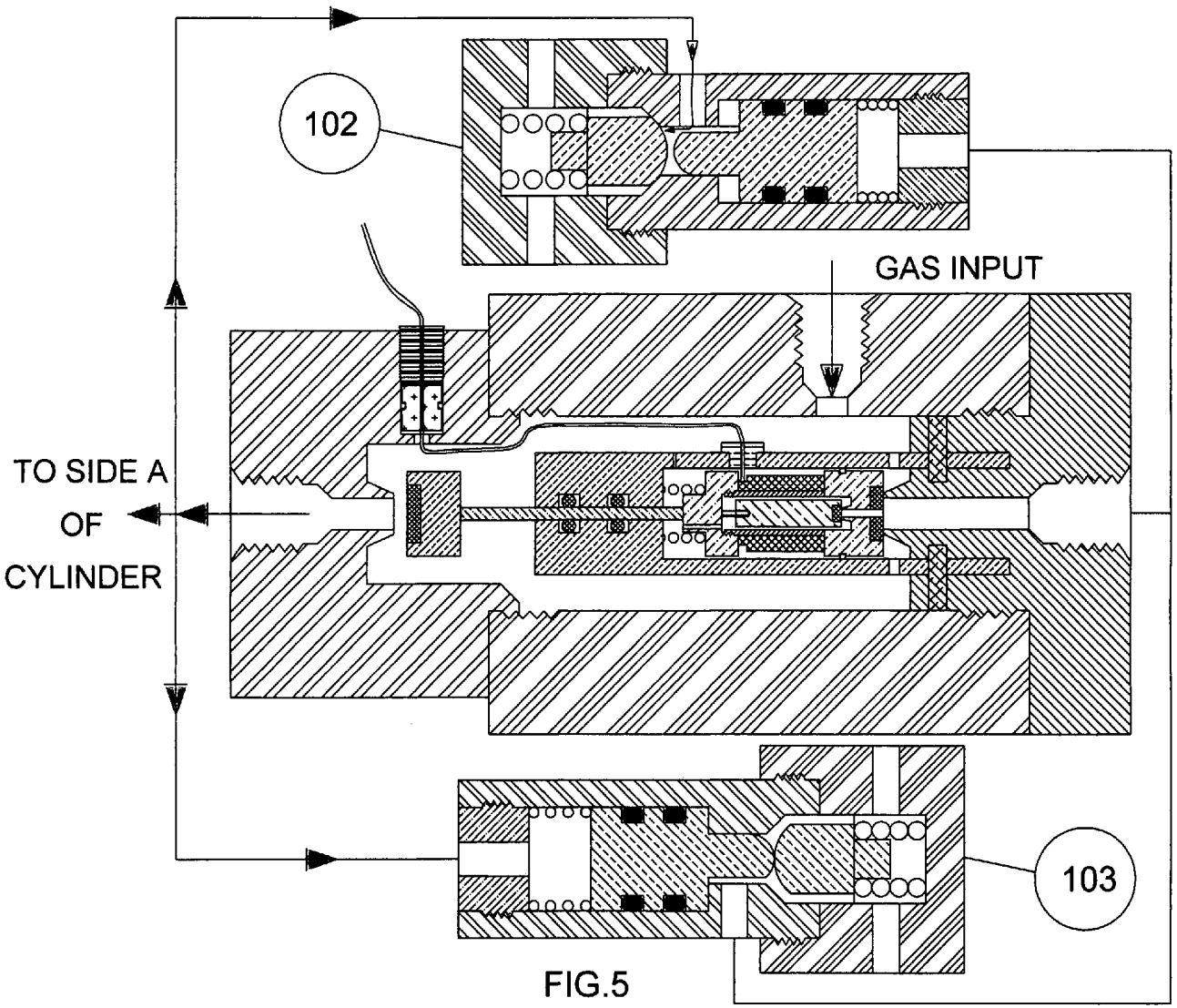
FIG. 5 is a connection diagram of modified in-tube solenoid gas valve and two gas release valves in the state that the gas starts to input into valves and the solenoid is de-energized.

FIG. 5 shows when the gas is allowed to flow into the modified solenoid gas valve 101. Initially, the compression spring 17 pushes the magnetic rod 15 to seal bleed orifice 33 to port 35 and compression spring 12 pushes solenoid assembly 6 to seal gas to port 35. Gas flows through the input port 41 of the modified in-tube solenoid gas valve 101 via cavity 22 and exiting through the port 34. The exiting gas enters port 47 of gas release valve 102, port 55 of gas release valve 103 and the side A of cylinder 104 simultaneously. In the pressure release gas valve 103, the gas enters chamber 54 via port 55 and builds up the pressure in chamber 54. The sum of forces of gas pressure in chamber 54 and compression spring 50 is greater that of compression spring 42. Piston 57 pushes piston 58 to open valve. In gas release valve 102, gas from input port 41 flows to chambers 53 and 59 via port 47 and port 34. The force exerted by gas pressure in chambers 53 and 59 is greater than that of compression spring, so that, compression spring 50 is compressed and body piston 57 is separated from cap piston 58. However, the force exerted by gas pressure in chambers 53 and 59 is less than that of compression spring 42, and cap piston 58 remains to seal valve. In cylinder 104, the exiting gas from modified in-tube solenoid gas valve 101 flows into side A of the system cylinder pushes the piston towards side B. The residue gas initially in side B of cylinder 104 is being "squeezed" out and enters the gas release valve 103 via port 47. Because valve is open, the exiting gas from side B of cylinder 104 can escape through chamber 52 and port 43 to atmosphere. At this stage, while the solenoid remains inactive, the gas filled up the chambers 26, 16 and 29 via pass-through holes 27, 31 and 30. Because the pressure between chamber 26 and chamber 29 is equal, with the action of the compression spring 12, the modified in-tube solenoid gas valve remains closed.

Figure 6:
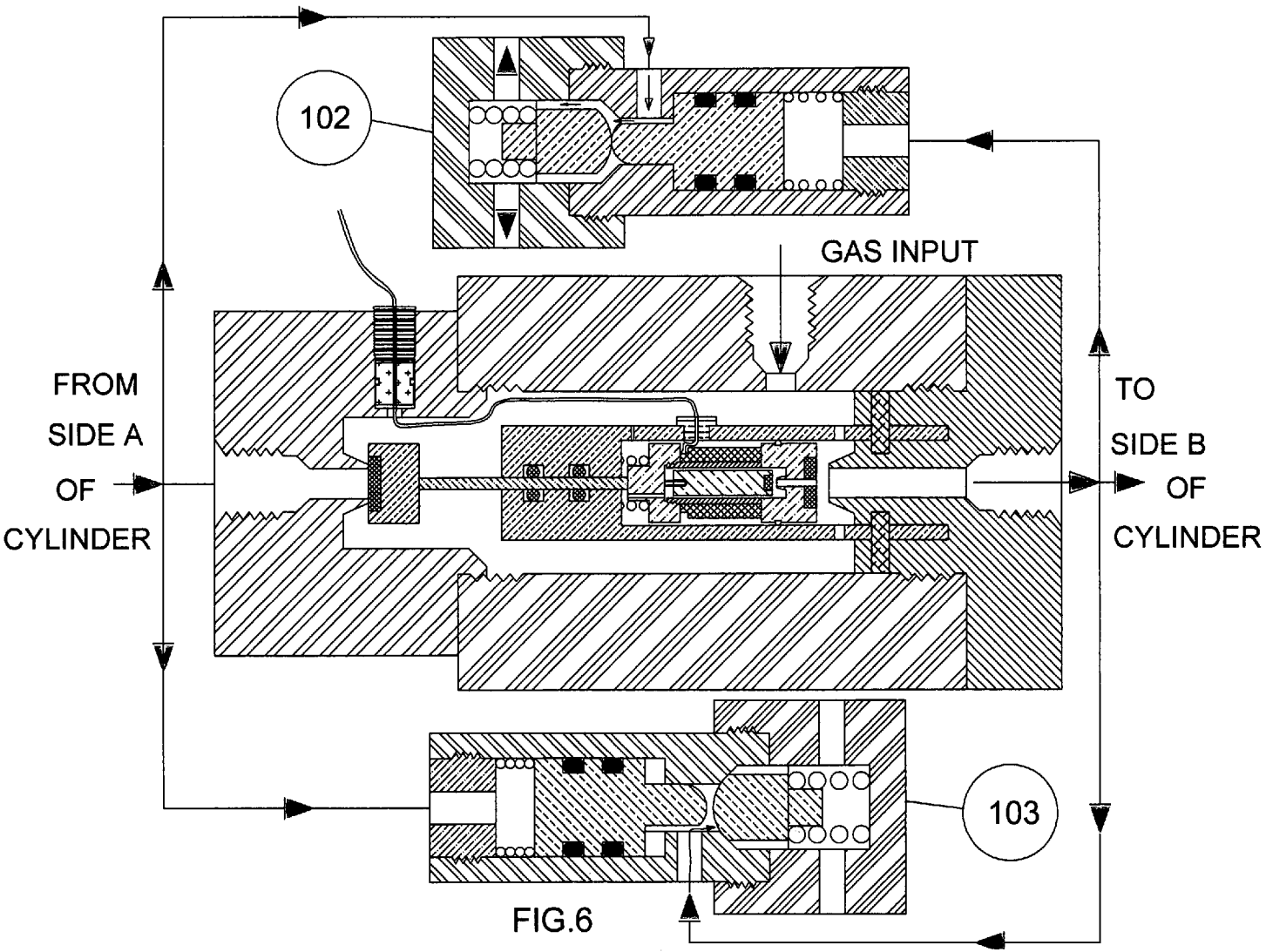
FIG. 6 is a connection diagram of modified in-tube solenoid gas valve and two gas release valves in the state that the gas is in valves and the solenoid is energized.
Figure 7:
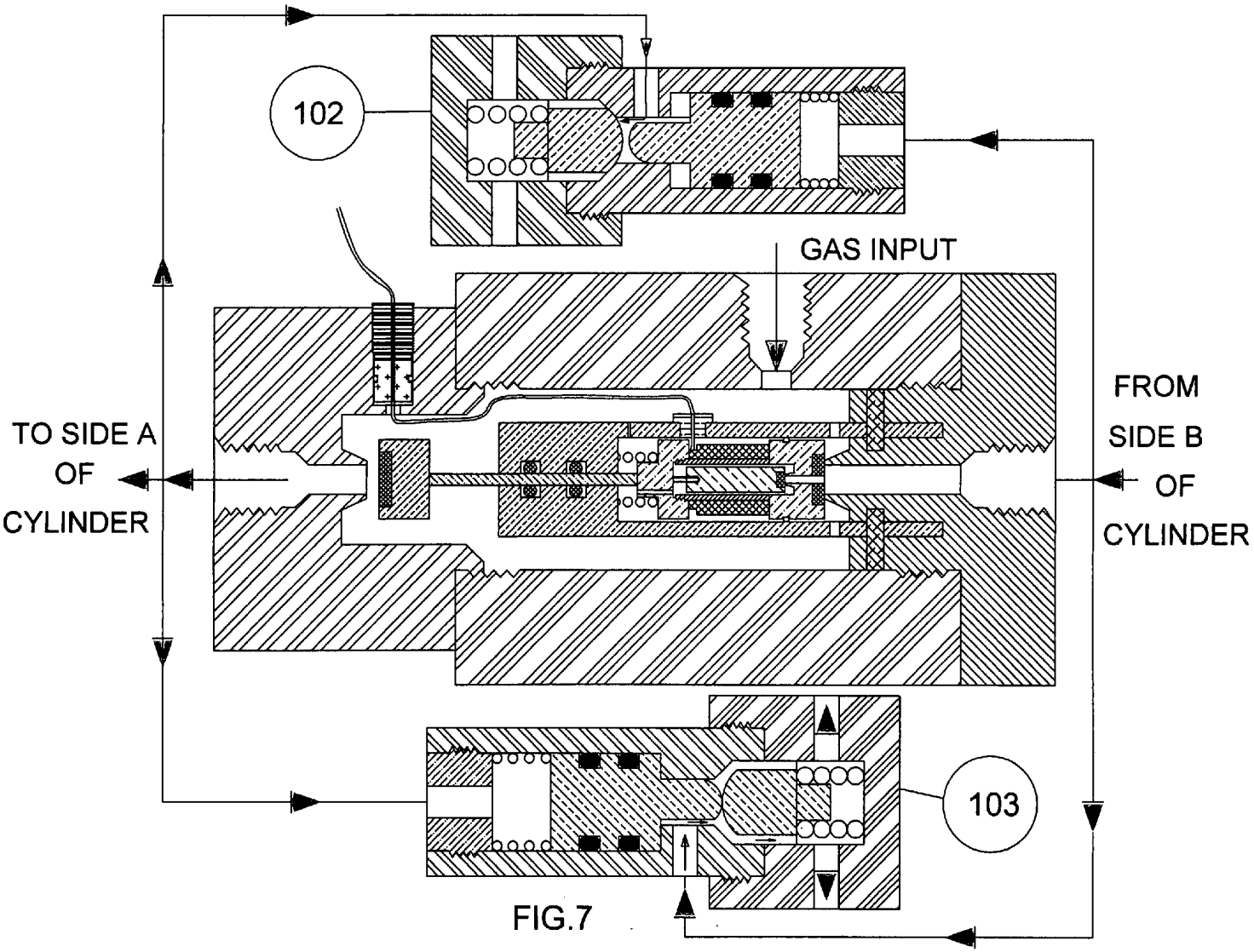
FIG. 7 is a connection diagram of modified in-tube solenoid gas valve and two gas release valves in the state that the gas is in valves and the solenoid is de-energized again.

When the solenoid in the modified in-tube solenoid gas valve 101 is active, as shown in FIG. 6, the bleed orifice 33 opens to allow gas in the front side chambers 7 and 16 to flow to the port 35, and thus reduces the pressure in the front side chamber 7. Because the pressure in the back side chamber 29 is greater than that of the front side chamber 7 , the valve opens. (For detailed operation, please refer to U.S. Ser. No. 10/924,789). Due to the movement of the solenoid assembly 6 in the modified in-tube solenoid gas valve 101, piston 38 presses against seal seat 40 of outlet fitting 2 and thus closes port 34 and opens port 35. When port 35 is open, incoming gas through port 41 enters cavity 22 and exits at port 35 via through-hole 30. The exiting gas enters the port 55 of gas release valve 102, port 47 of gas release valve 103 and side B of cylinder 104 simultaneously. In gas release valve 102, the exiting gas from the modified in-tube solenoid gas valve 101 enters chamber 54 via port 55 and builds up the pressure in chamber 54. Because the sum of the force created by gas pressure in chamber 54 and the force exerted by the compression spring 50 is larger than the force exerted by the compression spring 42 and by gas pressure in chamber 53, piston 57 pushes piston 58 to move and opens valve. The gas in side A of cylinder 104 is released to atmosphere. Because chambers 54 and 53 are not communicating, the exiting gas from the modified in-tube solenoid gas valve remains in chamber 54.

The exiting gas enters chamber 59 of the pressure release valve 103 via port 47. Because the force exerted by pressure in the chamber 53 and 59 is less than that of by the compression spring 42, piston 58 remains unmoved. In cylinder 104, the exiting gas from the modified in-tube solenoid gas valve enters the side B of the pneumatic system cylinder 104 causes the piston to move towards side A of the system cylinder. The gas that was in the side A of the system cylinder is being "squeezed" out into both pressure release valve 102 and 103. Because the only pressure release valve 102 is open at the moment, the gas in side A of cylinder 104 vents out through port 47 and outlet port 43.

When the solenoid is turned off, as shown in FIG. 1, the magnetic rod 15 moves back to block the bleed orifice 33. As the gas fills the front side chambers 7 and 16, the gas pressure between front side chamber 7 and back side chamber 29 is equalized, and by the act of compression spring 12, the solenoid assembly 6 moves back to close port 35. At the same time, it opens port 34. Gas flows through port 41 and exiting through port 34 via cavity 22 into port 47 of gas release valve 102, port 55 of gas release valve 103 and side A of cylinder 104. In gas release valve 103, the gas enters chamber 54 via the inlet 55. The pressure build up in chamber 54 pushes the piston 57 which in turn pushes piston 58. As a result of the movement of piston 58, the valve is opened. The gas in the side B of cylinder 104 is released to atmosphere. In gas release valve 102, gas enters chambers 59 and 53 via groove 48. Since the force exerted by gas in the chambers 53 and 59 is greater than that by compression spring 50, piston 57 is separated from piston 58. Because the force exerted by the compression spring 42 is large enough to overcome the pressure build up in chambers 53 and 59, piston 58 remains unmoved. no gas is escaping through gas release valve 102. However, because chambers 54 and 59 are not in communication, exiting gas from port 34 of the modified in-tube solenoid gas valve 101 remains in the chamber 54. The exiting gas from the modified in-tube solenoid gas valve 101 enters the side A of cylinder 104 which pushes the piston towards side B of the system cylinder. The gas that was in the side B of the system cylinder is then being "squeezed" out to the two gas release valves 102 and 103 and the port 35 of the modified in-tube solenoid gas valve 101. Because the port 35 of the modified in-tube solenoid gas valve 101 is closed, the gas from side B of cylinder 104 can only flow to gas release valves 102 and 103. However, since only gas release valve 103 has a route for venting the gas, via passage way 48 and port 43, all gas eventually will exit through this route.

What is claimed is:

1. A solenoid gas valve (101) comprising:

a valve tube (1) defining: a gas input port (41) for receiving a flow of gas; two outlet passages; and a cavity (22) communicating with the gas input port (41) and the outlet passages;

a normally-open outlet fitting (2) and a normally-closed outlet fitting (3) respectively fitted into said outlet passages to provide gas exit ports (34),(35) having seal seats (40),(13), one (13) of the seal seats being for the gas exit port (35) of the normally-closed fitting (3) and the other (40) of the seal seats being for the gas exit port (34) of the normally-open fitting (2);

a support cylindrical body (4) defining pass-through holes (27) and (30) and being secured in the cavity (22) to the normally-closed outlet fitting (3) to define a chamber (26) to which the gas exit port (35) of the normally-closed fitting (3) leads and to which the pass-through holes (27) and (30) lead;

a solenoid assembly (6) fitted and slidable within the chamber (26) defined by the support cylindrical body (4), the solenoid assembly:

including an electrical coil (11);

being disposed in sealed relation in the support cylindrical body (4) so as to divide the chamber (26) defined by the support cylindrical body (4) to a front side chamber (7) which communicates with one (27) of the pass-through holes and a back side chamber (29) which communicates with the other (30) of the pass-through holes defining: a hollow chamber (16); an interior orifice seal seat (18); a seal (14); and a bleed orifice (33) leading between an interior orifice seal seat (18) and the one (13) of the seal seats;

a rod-piston assembly including:

a rod (37) attached to the solenoid assembly (6) and passing through the support cylindrical body (4) into said cavity (22) in sealed relation to said support cylindrical body (4) so as to prevent gas communication between said cavity (22) and said front side chamber (7); and a piston (38) with a seal (39), attached to the rod (37) of the rod-piston assembly;

a magnetic rod (15) fitted and slidable within the hollow chamber (16);

a spring (17) for and urging said magnetic rod (15) towards the interior orifice seal seat (18) to seal said bleed orifice (33);

a spring (12) for and urging said solenoid assembly (6) towards the one (13) of the seal seats to seal the gas exit port (35) of the normally-closed outlet fitting (3);

wherein the electric coil (11) provides a magnetic field for movement of said magnetic rod (15) in the solenoid assembly (6); and the solenoid assembly (6) and the rod-piston assembly are movable between a position wherein the piston (38) of the rod-piston assembly seals against the other (40) of the seal seats and a position wherein the seal (14) of the solenoid assembly (6) seals against the one (13) of the seal seats.

2. An assembly for controlling a pneumatic cylinder (104) having a piston separating the cylinder into a side A and a side B, the assembly comprising:

the solenoid gas valve (101) of claim 1; and a pair of gas release valves (102), (103), each of said pair of gas release valves including:

a segregated chamber (54,53) which is segregated by a body piston (57) into two chambers (54),(53);

a chamber (52) having a cap piston (58) disposed therein;

a chamber (59): which communicates with the segregated chamber via one (53) of the two chambers: which communicates with the chamber (52) having the cap piston (58) disposed therein; and which terminates in a sealing seat (45) in the chamber (52) having the cap piston (58) disposed therein;

a spring (50) for the body piston (57) and a spring (42) for the cap piston (58) which urge the body piston (57) and the cap piston (58) towards one another and urge the cap piston (58) against the sealing seat (45);

a gas inlet (47) communicating with the chamber (59) which communicates with the one (53) of the segregated chamber;

a gas outlet (43) communicating with the chamber (52) having the cap piston (58) disposed therein; and a port (55) communicating with the other (54) of the two chambers;

the gas exit port (34) of said normally-open outlet fitting (2) being connected in use to the one side (A) of said pneumatic cylinder (104), to the gas inlet (47) of the one (102) of the pair of gas release valves and to the port (55) of the other (103) of the pair of gas release valves; and the gas exit port (35) of said normally-closed outlet fitting (3) being connected in use to the other side (B) of said pneumatic cylinder (104), to the gas inlet (47) of the other (103) of the gas release valves and to the port (55) of the one (102) of the gas release valves;

wherein, in use, when the gas is introduced into the solenoid gas valve (101), initially, in the solenoid gas valve (101), the spring (17) for the magnetic rod (15) pushes the magnetic rod (15) to seal against the interior orifice seal seat (18) to close the bleed orifice (33); the spring (12) for the solenoid assembly (6) pushes the solenoid assembly (6) to seal against the one (13) of the seal seats and close the gas exit port (35) of the normally-closed outlet fitting (3); gas flows through the gas input port (41) via cavity (22) and exits through the gas exit port (34) of the normally-open outlet fitting (2);

in the other (103) of the gas release valves, gas from the gas exit port (34) of the normally-open outlet fitting (2) enters the other (54) of the two chambers via port (55) and builds up pressure therein until such time as the sum of forces of gas pressure in the other (54) of the two chambers and the spring (50) for the body piston (57) exceeds that of the spring (42) for the cap piston (58) whereupon the spring (50) for the body piston (57) pushes the cap piston (58) to provide an open path to atmosphere between the gas inlet (47) and the gas outlet (43);

in the one (102) of the gas release valves, gas from the gas exit port (34) of the normally-open outlet fitting (2) flows, via the gas inlet (47), to the one (53) of the two chambers and to the chamber (59) which communicates with the segregated chamber (53,54);

the force exerted by gas pressure in the one (53) of the two chambers and the chamber (59) which communicates with the segregated chamber (53,54) overcomes and compresses the spring (50) for the body piston to separate the body piston (57) from the cap piston (58), with the spring (42) for the cap piston keeping the cap piston (58) seated against sealing seat (45);

in the pneumatic cylinder (104), the exiting gas from the gas exit port (34) of the normally-open fitting (2) flows into side (A) thereby to push the piston of said cylinder (104) towards side (B), expelling gas from side (B) which exits to atmosphere via the open path in the other (103) of the gas release valves;

when the coil (11) is energized, in the solenoid gas valve (101), the magnetic rod (15) moves, to unseat from the interior orifice seal seat (18) and to open the bleed orifice (33) to allow gas, in the hollow chamber (16) and the chamber (26) defined by the support cylindrical body (4), to flow to the gas exit port (35) of the normally-closed fitting (3), thereby: reducing the pressure in the chamber (26) defined by the support cylindrical body (4); and causing the solenoid assembly (6) to unseat from the one (13) of the seal seats and piston (38) of the rod-piston assembly to seat against the other (40) of the seal seats, thereby to open the gas exit ports (35),(34), such that gas incoming through the gas input port (41) exits the gas exit port (35) of the normally-closed fitting (3) via the other of the pass-through holes (30);

in the one (102) of the gas release valves, the exiting gas from solenoid gas valve (101) enters the other (54) of the two chambers via port (55) of the other (103) of the gas release valves and builds up pressure therein such that the sum of the force created by gas pressure in the other (54) of the two chambers and the force exerted by the spring (50) for the body piston (57) exceeds the force exerted by spring (42) for the cap piston (58) and by gas pressure in the one (53) of the two chambers, whereupon the body piston (57) pushes the cap piston (58) to open a path for fluid between the gas inlet (47) and the gas outlet (43);

in the other (103) of the gas release valves, the gas exiting from the solenoid gas valve (101) enters the chamber (59) which communicates with the segregated chamber (53,54), but because the force exerted by pressure in the one (53) of the two chambers and the chamber (59) which communicates with the segregated chamber (53,54) is less than that of the spring (42) for the cap piston (58), the cap piston (58) remains seated against sealing seat (45);

in the pneumatic cylinder (104), the gas exiting from solenoid gas valve (101) enters side (B) of the cylinder (104) to cause the piston thereof to move towards side (A) of the system, expelling gas from side (A) which vents to atmosphere through the open path in the one (102) of the gas release valves;

when the solenoid is de-energized, in the solenoid gas valve (101), the magnetic rod (15) moves to seal against the interior orifice seal seat (18) and block the bleed orifice (33) such that gas fills the hollow chamber (16) and the chamber (26) defined by the support cylindrical body (4) to equalize the pressure between the chamber (26) defined by the support cylindrical body (4) and the back-side chamber (29), whereupon the spring (12) for the solenoid assembly urges solenoid assembly (6) to move, to unseat the rod (38) of the rod-piston assembly from the other (40) of the seal seats and push the seal (14) of the solenoid assembly (6) against the one (13) of the seal seats, to close gas exit port (35) of the normally-closed outlet fitting (3) and to open the gas exit port (34) of the normally-open outlet fitting (2) such that gas exits through gas exit port (34) of the normally-open outlet fitting (2) via cavity (22);

in the other (103) of the gas release valves, gas enters the other (54) of the two chambers via the port (55) and builds pressure therein to unseat cap piston (58) via body piston (57), to provide a path between the gas inlet (47) and the gas outlet (43);

in the one (102) of the gas release valves, gas enters, via groove (48), the one (53) of the two chambers and the chamber (59) which communicates with the segregated chamber (53,54) such that the force exerted by the gas therein is greater than that exerted by the spring (50) for the body piston (57) so as to separate the body piston (57) from the cap piston (58), but because the force exerted by the spring (42) for the cap piston (58) is large enough to overcome the pressure built up in the one (53) of the two chambers and the chamber (59) which communicates with the segregated chamber (53,54), the cap piston (58) remains seated against sealing seat (45);

in the pneumatic cylinder (104), gas exiting from the gas exit port (34) of the normally-open outlet fitting (2) enters side (A) to push the piston of cylinder (104) towards side (B) and cause the expulsion of gas from side (B) gas to atmosphere, via the open path of second gas release valve (103).

3. The assembly of claim 2, wherein: the outlet fittings (2),(3) are threaded into the outlet passages of the valve tube (1); the support cylindrical body (4) is inserted into said normally closed outlet fitting (3) by pins; the solenoid assembly (6) further includes a flange (10), a stop (9) and a sleeve (8); an o-ring (28) located in flange (10) provides for said division of the chamber (26) defined by the support cylindrical body (4) into the front side chamber (7) and the back side chamber (29); the flange (10) includes the one (13) of the seal seats; a plastic insert (14) is molded onto the flange (10) to define the seal (14) of the solenoid assembly (6); a plastic insert (39), molded onto the piston (38) of the rod-piston assembly, seals against the other (40) of the seal seats when the gas exit port (34) of the normally-open outlet fitting (2) is closed; to prevent said gas communication between said cavity (22) and said front side chamber (7), a pair of o-rings (36) located circumferentially around the rod (37) of the rod-piston assembly are provided; a rubber insert (19)is molded onto said magnetic rod (15) to seal against the bleed orifice (33); the coil (11) is energized via lead wires (32) which pass through the hole of an internal pass-through plug (20) which is inserted into said support cylindrical body (4) and is used for the purpose of strain relief.

* * * * *